US008668169B2

(12) United States Patent
Nichter

(10) Patent No.: US 8,668,169 B2
(45) Date of Patent: Mar. 11, 2014

(54) COMMUNICATIONS BASED CROSSING CONTROL FOR LOCOMOTIVE-CENTRIC SYSTEMS

(75) Inventor: Kevin Nichter, Prospect, KY (US)

(73) Assignee: Siemens Rail Automation Corporation, Louisville, KY (US)

( * ) Notice: Subject to any disclaimer, the term of this patent is extended or adjusted under 35 U.S.C. 154(b) by 423 days.

(21) Appl. No.: 13/078,464

(22) Filed: Apr. 1, 2011

(65) Prior Publication Data

US 2012/0248261 A1 Oct. 4, 2012

(51) Int. Cl.
*B61L 29/24* (2006.01)

(52) U.S. Cl.
USPC ..... 246/125; 246/293

(58) Field of Classification Search
USPC ..... 246/125, 182 R, 293
See application file for complete search history.

(56) References Cited

U.S. PATENT DOCUMENTS

| | | | | |
|---|---|---|---|---|
| 4,711,418 | A | 12/1987 | Aver, Jr. et al. | |
| 5,098,044 | A | 3/1992 | Petit et al. | |
| 5,533,695 | A | 7/1996 | Heggestad et al. | |
| 5,620,155 | A | 4/1997 | Michalek | |
| 5,785,283 | A | 7/1998 | Ehrenberger et al. | |
| 5,978,718 | A | 11/1999 | Kull | |
| 6,081,769 | A | 6/2000 | Curtis | |
| 6,915,191 | B2 | 7/2005 | Kane et al. | |
| 6,996,461 | B2 | 2/2006 | Kane et al. | |
| 7,036,774 | B2 | 5/2006 | Kane et al. | |
| 7,079,926 | B2 | 7/2006 | Kane et al. | |
| 7,236,860 | B2 | 6/2007 | Kane et al. | |
| 7,593,963 | B2 | 9/2009 | Ballesty et al. | |
| 7,729,819 | B2 * | 6/2010 | Rajaram | 701/19 |
| 7,731,129 | B2 | 6/2010 | Stull et al. | |
| 7,832,691 | B2 * | 11/2010 | Reibeling et al. | 246/125 |
| 8,297,558 | B2 * | 10/2012 | O'Dell et al. | 246/126 |
| 2006/0015224 | A1 | 1/2006 | Hilleary | |
| 2006/0180712 | A1 * | 8/2006 | Hill | 246/293 |
| 2008/0068164 | A1 * | 3/2008 | Campbell | 340/572.1 |
| 2008/0315044 | A1 * | 12/2008 | Stull et al. | 246/5 |
| 2009/0043435 | A1 * | 2/2009 | Kane et al. | 701/19 |
| 2009/0184214 | A1 * | 7/2009 | Reibeling et al. | 246/125 |
| 2009/0187295 | A1 * | 7/2009 | Meyer et al. | 701/19 |
| 2011/0095139 | A1 * | 4/2011 | O'Dell | 246/293 |
| 2011/0226909 | A1 * | 9/2011 | O'Dell et al. | 246/126 |
| 2012/0181390 | A1 * | 7/2012 | Ashraf et al. | 246/122 R |
| 2012/0248261 | A1 * | 10/2012 | Nichter | 246/125 |

* cited by examiner

*Primary Examiner* — Jason C Smith

(57) ABSTRACT

A train equipped with an onboard system for determining its position and a track database for determining the positions of upcoming grade crossings sends activate after expiration messages to control wayside warning systems at the crossings to achieve a constant warning time while maintaining a safety margin that ensures the train can be stopped if the wayside systems do not respond correctly to the activate after expiration messages. The system may be used in place of existing track-based crossing warning system control circuits. Communications between the train may be radio-based, and may be direct between the train and wayside devices or may be routed through a central station, which may act as a relay or maintain a database. The train may control multiple crossings at one time, thereby eliminating the need for downstream adjacent crossing control.

18 Claims, 4 Drawing Sheets

COMMUNICATIONS BASED CROSSING CONTROL FOR LOCOMOTIVE-CENTRIC SYSTEMS

BACKGROUND

Railroad grade crossings (sometimes referred to in the U.K. as level crossings) are locations at which railroad tracks intersect roads. Avoiding collisions between people, trains and automobiles at grade crossings has always been a matter of great concern in the railroad industry.

Warning systems have been developed to warn people and cars of an approaching train at a grade crossing. These warning systems typically include lights, bells and one or more gate arms (e.g., the familiar black and white striped wooden or fiberglass arms often found at highway grade crossings) that block the road and/or sidewalks when a train is approaching the crossing. The lights, bells and gate arms of these warning systems are typically controlled by a controller. Most controllers in use in the U.S. today utilize an input from a grade crossing predictor circuit to determine when to activate the warning system. A crossing predictor circuit is an electronic device which is connected to the rails of a railroad track and is configured to detect the presence of an approaching train, determine its speed and distance from a crossing, and use this information to generate a constant warning time signal for control of a crossing warning device. Other techniques for providing an input to a controller include laser-based systems for detecting a train and determining its distance and speed.

These known systems share a common characteristic: they are independent of any active signal from a train. In other words, these systems detect a train but do not rely on the train to generate any control signals.

Another characteristic of these known systems is that, although they are highly reliable, they are not perfect and have been known to malfunction on occasion. Such a malfunction can take the form of a warning system activating (e.g., a gate staying in a lowered position) when no train is approaching and, more dangerously, a warning system failing to activate (e.g., a gate staying in the raised position) when a train is approaching.

A more recent development in train safety has been the use of positive train control, or PTC, systems onboard locomotives. These systems are designed to prevent collisions between trains, to enforce speed restrictions, and to perform other safety-related functions. Although these systems vary widely in their implementation, many of them share common characteristics such as a positioning systems and map databases that allow a locomotive to determine its position relative to a track system and communications system that allow the locomotive to communicate with devices located off of the train.

It is known in the art to utilize such locomotive PTC systems as a means to ensure that a train does not pass a grade crossing when a warning system is malfunctioning. The leading patent in this area is U.S. Pat. No. 6,996,461 to Kane et al. In Kane's system, a train approaching a grade crossing transmits an interrogation signal to a wayside device such as a grade crossing controller prior to reaching the grade crossing, and does not go through the crossing if a response indicating that the warning system has been properly activated has been received. Note that Kane's system does not trigger activation of the crossing warning system or control it in any way; rather, Kane's system only interrogates the wayside warning system to determine if it has activated prior to the train passing the crossing.

Another system, described in U.S. Pat. No. 5,620,155 to Michalek, discloses an system located onboard a locomotive that can send a signal to a wayside warning system to activate the wayside warning system. Michalek's system, however, operates by sending an activation signal to the warning system when the train is at a predetermined distance from the crossing. This is wasteful as such a scheme will cause the warning system to activate in advance of when necessary for a slow moving train (it being understood that the predetermined distance must be sufficiently spaced apart from the crossing to allow for a train traveling at the highest allowable speed). This drawback might be tolerable for rural crossings with warning devices consisting of only flashing lights as cars may be able to pull up to the tracks, determine the distance of the train, and proceed through the crossing if the train is still far away (although this is still wasteful as the car is forced to slow down or stop needlessly). However, such a system is far less tolerable for crossings with gates that prevent cars from going through the crossing when the warning system is active.

DETAILED DESCRIPTION

In the following detailed description, a plurality of specific details, such as time periods and types of communications systems, are set forth in order to provide a thorough understanding of the preferred embodiments discussed below. The details discussed in connection with the preferred embodiments should not be understood to limit the present inventions. Furthermore, for ease of understanding, certain method steps are delineated as separate steps; however, these steps should not be construed as necessarily distinct nor order dependent in their performance.

Figure 1:
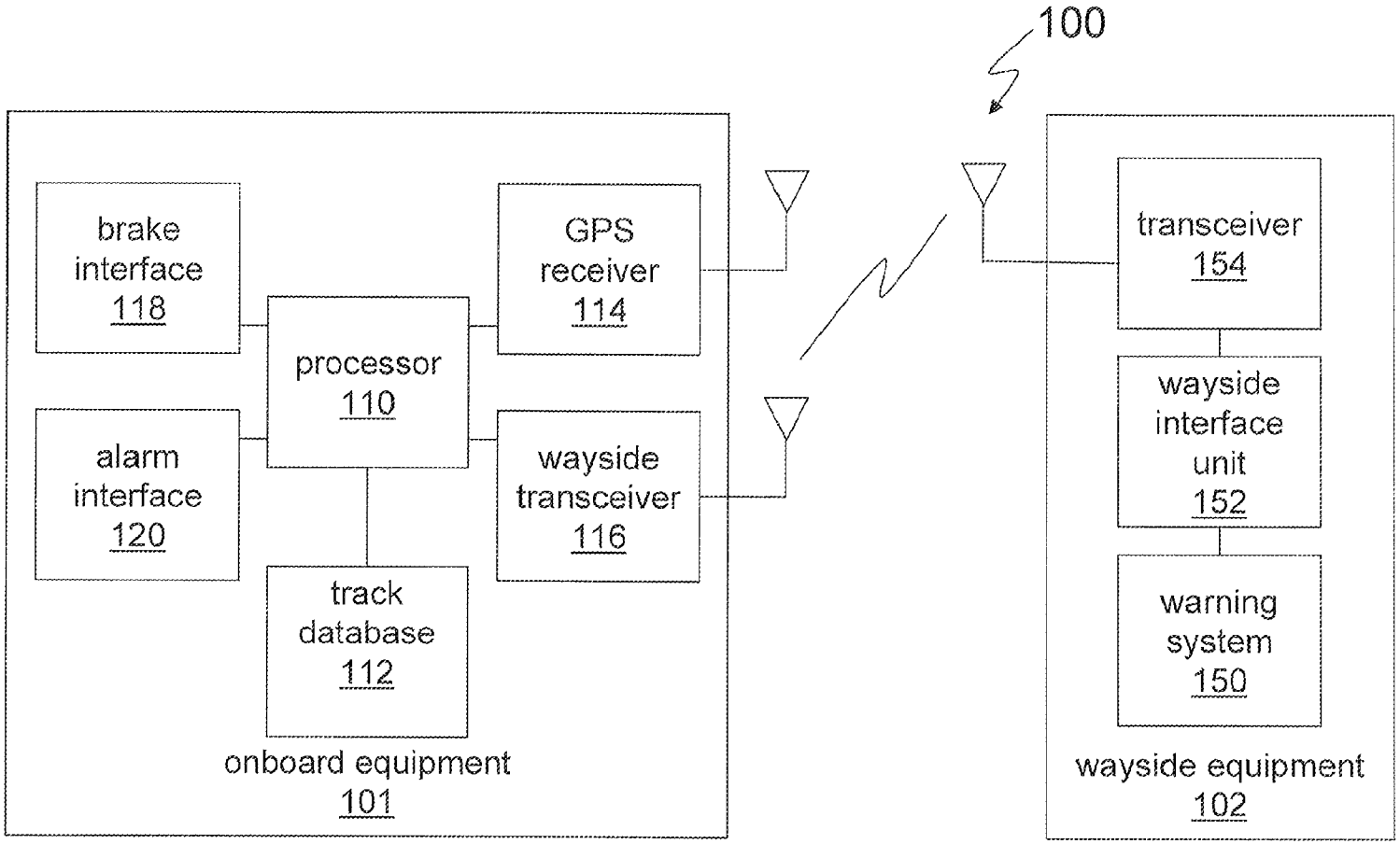
FIG. 1 is a hardware block diagram of a communication based crossing control system according to one embodiment.

A hardware block diagram of a system 100 for controlling a grade crossing warning system according to one embodiment is illustrated in FIG. 1. The system 100 includes onboard equipment (i.e., equipment located onboard a train) 101 and wayside equipment (i.e., equipment located along a wayside of a train track) 102. The onboard may be present on one vehicle of the train, such as a lead locomotive, or may be located on several vehicles. In some embodiments, each locomotive is equipped with a complete set of the onboard equipment 102, and only one set is active at any one time. Although only one set of onboard equipment 101 is shown in FIG. 1, it should be understood that there may be a set of onboard equipment 101 for each train in a rail system, and similarly there may be many sets of wayside equipment 102 (e.g., one set for each crossing) in the rail system.

The onboard equipment 101 is controlled by a processor 110. The processor 110 may be a microprocessor, a microcontroller, a programmable logic array, fabricated from discrete logic, or may be realized using any other devices or methods known in the art. As used herein, the terms "processor," "computer" or the like should be understood to refer to one device or a plurality of devices. Thus, a statement that a processor or computer performs a step or series of steps should be understood to mean that one or more processors or computers performs the step or series of steps. The processor 110 is programmed to perform the functions described below. The processor is connected to a GPS receiver 114, from which it receives messages including the location of the train. In some embodiments, the messages may further include a time, a heading, and a speed. The GPS receiver 114 may be, e.g., a commercially available RF receiver utilizing a SiRFstar III chipset. As illustrated in FIG. 1, the GPS receiver 114 is connected to an antenna.

The processor 110 is also connected to a track database 112. The track database 112 is used by the processor 110 to translate position reports in latitude/longitude from the GPS receiver 114 to positions on the track (often expressed in terms of miles relative to some fixed position on the track, in the manner of mileposts but with greater precision). The track database 140 preferably includes a non-volatile memory such as a hard disk, flash memory, CD-ROM or other storage device, on which track data is stored. Other types of memory, including volatile memory, may also be used. In preferred embodiments, the track data comprises latitude and longitude coordinates for a plurality of points corresponding to different locations on the track in a manner well known in the art. The points are not necessarily uniformly spaced. In some embodiments, the points are more closely spaced where the track is curved and less closely spaced where the track is straight. The route or path between points in the database can be described as a vector, and the processor may determine the train's position along the track by determining the point on the vector that is closest to the position reported by the GPS receiver as described in U.S. Pat. Pub. No. 20090043435, the contents of which are hereby incorporated herein by reference.

The processor 110 is also connected to a wayside transceiver 116. The wayside transceiver 116 may be any device capable of communicating with a wayside device. In some embodiments, the wayside transceiver 116 is an RF transceiver, such as the 220 MHz radios currently available from MeteorComm. The wayside transceiver 116 is connected to an antenna as shown in FIG. 1, which is typically but not necessarily separate from the antenna used by the GPS receiver 114. As will be explained further below, the processor 110 communicates with wayside equipment 102 via the wayside transceiver 116.

A brake interface 118 and alarm interface 120 are also connected to the processor 110. The brake interface may be of any type known in the art, and may configured to send a digital message to the braking system, or may be configured to generate an analog signal connected to a P2A valve to initiate an emergency or penalty brake operation. Similarly, the alarm interface 120 may be configured to interact with a simple alarm, such as generating an analog signal to drive a light or bell directly or via a relay, or may be configured to output a digital signal (e.g., a USB or RS-232C signal) to drive an operator display. The processor 110 uses the alarm interface 120 to warn the operator under certain conditions to be discussed further below. The brake interface 118 and the alarm interface 120 may be realized using discrete logic or by any other means depending on the systems with which they must interface.

As shown in FIG. 1, the onboard equipment 101 communicates with wayside equipment 102. In particular, the wayside equipment 102 utilizes a wireless transceiver 154 to communicate with the transceiver 116 onboard the train. The train transceiver may be, for example, an RF transceiver such as the 220 MHz radio transceivers currently available from MeteorComm. Other types of transceivers may be used in other embodiments as discussed below in connection with FIG. 2. The transceiver 154 may be connected to a wayside interface unit 152, which in turn may be connected to control a wayside warning system 150. The wayside interface unit 152 may be realized using a microprocessor, a microcontroller, discrete logic, programmable logic arrays, or by any other means known in the art. The wayside interface unit 152 is responsible for communicating with trains and controlling the wayside warning system 150. The wayside warning system may be any conventional grade crossing warning system including one or more of cross bucks, bells, and lights.

Figure 2:
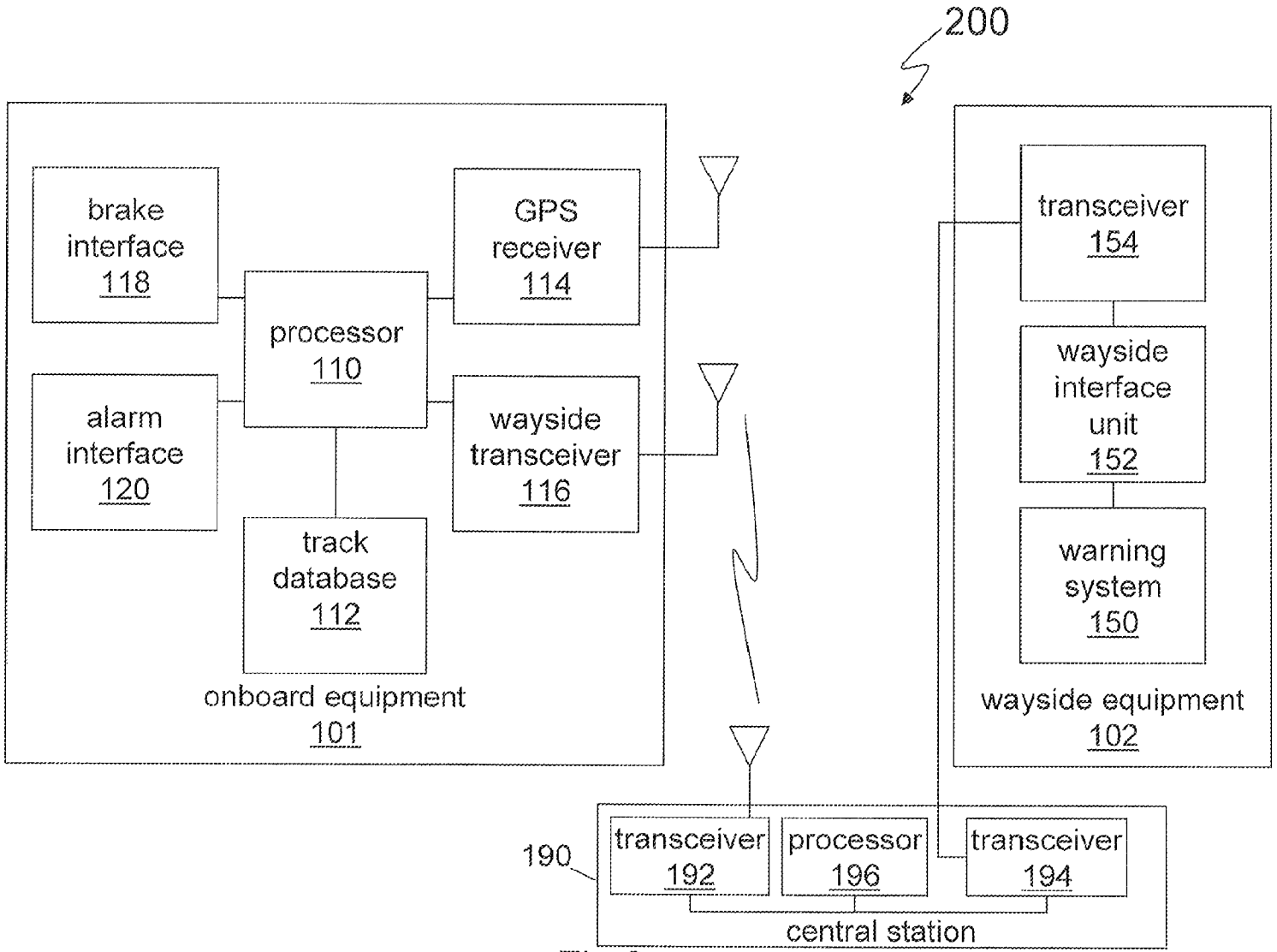
FIG. 2 is a hardware block diagram of a communication based crossing control system according to another embodiment.

FIG. 2 illustrates a hardware block diagram of a system 200 for controlling a grade crossing warning system according to another embodiment. An important difference between the system 100 of FIG. 1 and the system 200 of FIG. 2 is that the system 200 includes a central station 190 through which communications between the onboard equipment 101 and the wayside equipment 102 flow. The term "central station" does not imply that the station is located in a geographical center, although this may be the case. Rather, central station as used herein simply means that the central station 190 is in the communications path between the onboard equipment 101 and the wayside equipment 102. There may be a single central station 190 in a given rail system, or multiple central stations, each serving a portion of a rail system.

As shown in FIG. 2, the central station 190 includes a first transceiver 192, in this case a wireless transceiver, for communicating with the onboard equipment 101. The central station 190 also includes a second transceiver 194 for communicating with the wayside equipment 102. The second transceiver 194 shown in FIG. 2 is a wired transceiver, which is used in embodiments in which a wired network exists between the central station 190 and the wayside equipment 102. Alternatively, a wireless transceiver (which may be the same transceiver 192 used to communicate with the onboard equipment 101 or a different transceiver), or both wired and wireless transceivers, may be used in alternative embodiments. The central station 190 also includes a processor 196 connected to the transceivers 192, 194. The processor 196 acts as a router in some embodiments, simply routing messages from onboard equipment 101 to the wayside equipment to which they are addressed and vice-versa. In such embodiments, the processor need not concern itself with the content of any messages exchanged between the onboard equipment 101 and the wayside equipment 102. In other embodiments, the processor 196 is in the nature of a database server that receives status messages from the wayside equipment 102 that are sent periodically and upon a change in status of the equipment, maintains a database of the conditions of all wayside equipment 102 in the rail system, and reports the status of particular wayside equipment 102 based on information stored in the database in response to query messages from onboard equipment 102 as needed.

The processing performed by the processor 110 in one embodiment of the invention will now be discussed with reference to the flowchart 300 of FIG. 3. This processing is applicable to either system 100, 200 shown in FIG. 1 or 2. The process begins with the processor 102 determining the train speed and position at step 302. The current speed and position may be determined from information received from the GPS receiver 114. The processor 110 then determines whether any crossings are within a threshold range at step 304 by comparing the current train position and, optionally, speed, with crossing locations stored in the track database 112 based upon the route (e.g., the direction in which the train is traveling and the path the train will take through upcoming switches)

assigned to the train. The threshold range is chosen in order to allow sufficient time to establish communications with wayside equipment at upcoming crossings and allow the train to come to a complete stop if no communications session can be established. The threshold range may be static or dynamic. In some embodiments, a static range is chosen based on a maximum allowable speed in a railway system, plus a safety factor. In other embodiments, a dynamic threshold may be chosen based on the speed of the train.

If a new crossing is in range at step 304, the processor 110 attempts to establish a communication session with the wayside interface unit 152 at the crossing by transmitting a "session request" message at step 306. Preferably, the session request message is addressed to the specific wayside interface unit 152 identified in step 304 (as will be discussed in further detail below, there may be multiple wayside interface units within the threshold range of the train, and possibly even multiple wayside interface units being controlled by the train at any one time). If the wayside interface unit 152 fails to establish a communications session by responding to the session request message with an acknowledgement (ACK) message, or the ACK message is not received for some other reason, at step 308, the processor 110 assumes that there is a malfunction at proceeds under malfunction conditions at step 310. The train may proceed under malfunction conditions in a number of ways. For example, in some embodiments, the processor may ensure that the train comes to a complete stop prior to reaching the crossing, and then allow the train to proceed through the crossing at a low speed. Alternatively, the processor 110 may allow the train to proceed through the crossing at a low speed without coming to a complete stop. Those of skill in the art will recognize that other procedures are also possible, and all are within the scope of the invention.

If a communications session is established at step 308, the crossing is added to a list of active crossings at step 312, preferably in distance order starting with the nearest crossing. Once the crossing is added to the active list at step 312, or if no new crossings were in range at step 304, the processor 110 calculates an estimated arrival time for the crossing at the top of the list at step 314. The estimated arrival time (i.e., the estimated time at which the train will arrive at the crossing) is calculated based at least in part on the train speed and the distance between the current train position and the location of the crossing retrieved from the track database 112 (those of skill will recognize that more refined estimates could include a current acceleration of the train). The arrival time calculated in step 314 is compared to an arrival time threshold at step 316. The arrival time threshold is based on two values: a desired constant warning time (which is the desired time period prior to the train's arrival at the crossing that the wayside warning system 150 will activate, typically on the order of 30-40 seconds) plus a buffer time (typically on the order of ten seconds) which will be used by the wayside interface unit to start a timer as explained further below. The constant warning time may be a constant, or may be retrieved from the track database 112 in systems in which the desired constant warning time varies by crossing. In yet other embodiments, the wayside equipment 102 may be configured to inform the train of the desired constant warning time, such as in the ACK message transmitted in response to the session request message.

If the arrival time threshold has not been met at step 316, a maintain session message is sent to the wayside interface unit 152 at step 320. If the arrival time threshold has been met at step 316, an "activate after expiration" message will be sent at step 318. The activate after expiration message includes a timeout time discussed above, which will be used by the wayside interface unit 152 to set a timer. The timeout time is the difference between the desired constant warning time and the calculated arrival time. If the arrival time is exactly equal to the arrival time threshold, the timeout time in the activate after expiration message will be equal to the buffer time discussed above. If the arrival time is less than the threshold, the timeout time will necessarily be less than the buffer time and may be zero (signifying that the train has already passed the point at which the warning system 150 should have been activated). It should be understood that the process of FIG. 3, and in particular the steps 316 and 318, may be executed several times as the train approaches a particular crossing. In some embodiments, these steps may be repeated approximately once per second as the train approaches the crossing. If a train maintains a constant speed in such an embodiment, a series of activate after expiration messages may be sent, with the timeout time in each successive message decreasing by approximately one second. However, if the train is accelerating or decelerating as it approaches the crossing, the timeout time in the activate after expiration messages may vary by more than one second between successive message. If the train is decelerating, the timeout time may increase to avoid activating the crossing warning system 150 an unnecessarily long time before arrival of the train at the crossing. If the train were to slow down very much or stop, the result may be that arrival time threshold is no longer met for a crossing to which an activate after expiration message had previously been sent, which will be recognized by the crossing as an indication that the timer should be cleared.

After sending either the maintain session message at step 320 or the activate after expiration message at step 318, the processor 110 determines if the a responsive acknowledgement message is received from the wayside interface unit 152 at step 322. If the acknowledgement message is not received, or an acknowledgement indicating a malfunction or other non-satisfactory status is received, at step 322, the processor 110 ensures that the train proceeds under malfunction conditions at step 310 as described above. If an ACK message is received at step 322, the train's speed and position are updated (e.g., by checking the database and/or querying the GPS receiver 114) at step 324. Next, the processor determines whether additional active crossings are on the list at step 326. If so, step 314 is repeated for the next crossing on the list; otherwise, the process begins again at step 302.

Figure 4:
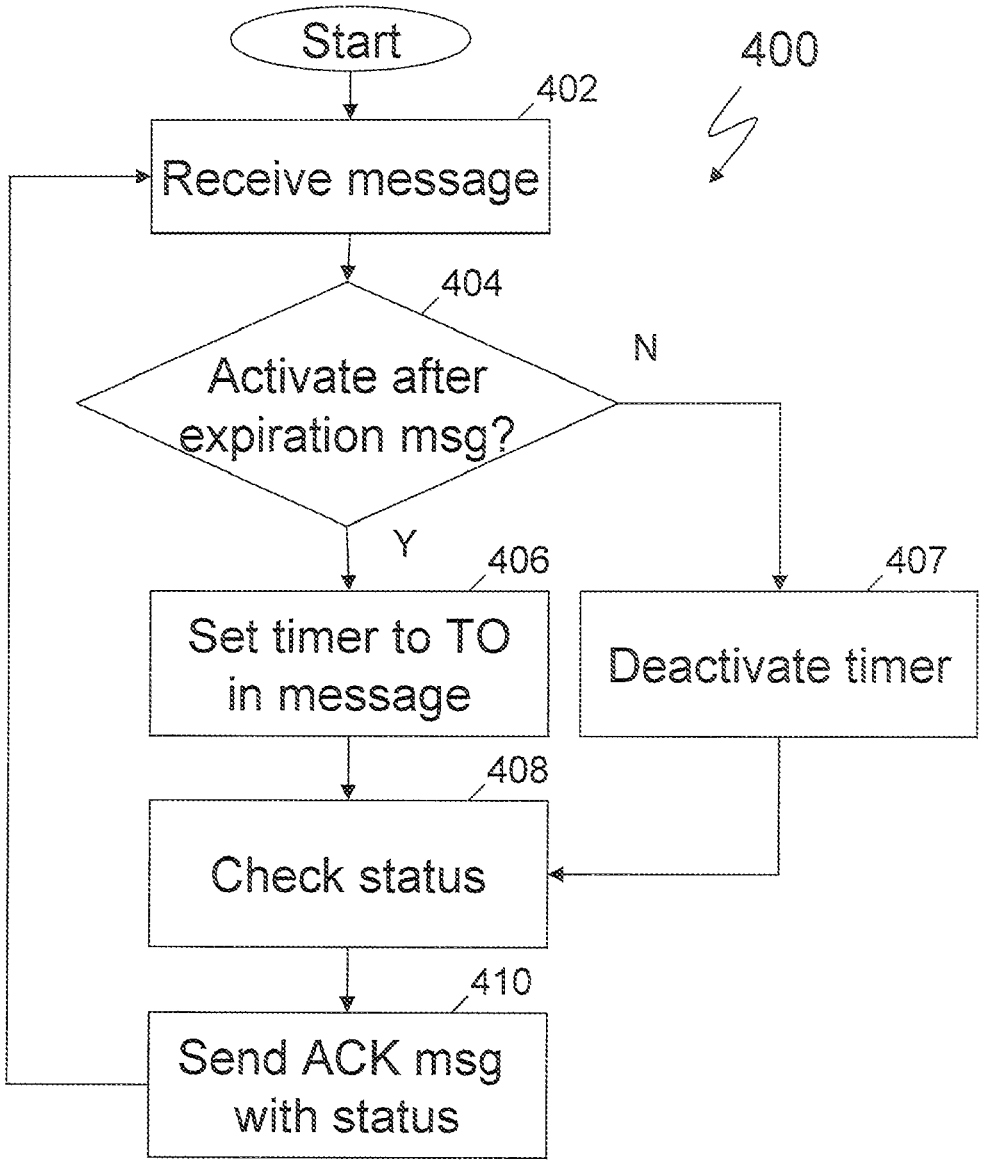
FIG. 4 is a flow chart illustrating actions performed by a wayside interface unit forming part of the system illustrated in FIG. 1.

FIG. 4 illustrates a flowchart 400 showing the processing performed by the wayside interface unit 152 according to one embodiment of the invention. The process starts with the receipt of a message from a train at step 402. The wayside interface unit determines whether the message is an activate after expiration message at step 404. If so, the wayside interface unit sets the timer to the TO value contained in the message at step 406 (the timer is actually being reset if the train had previously sent a message. The wayside interface unit 152 will maintain separate timers for each train (the maintain session and activate after expiration messages from the processor 110 of the onboard equipment 101 will include a train identifier in each message, and the wayside interface unit will assign a timer to a train upon receipt of the first message from the train), and the timer that will be set will be the timer correspond to the train ID in the message (if the timer was not previously active, this step includes activation of the timer). Multiple timers may be used because it is possible that multiple trains (e.g., trains coming in opposite directions) will be approaching the crossing from opposite directions, and the wayside interface unit 152 may be configured to activate the crossing warning system 150 upon the expiration of any timer. This will ensure that the one train with a differing approach time will not adversely effect the operation of the warning system 150 with respect to a second train, which may reach the crossing first. If the message was not an activate after expiration message at step 404 (which means that the message is either a session request message or a maintain session message since these are only other types of messages defined in this embodiment), the wayside interface unit 152 deactivates the timer at step 407. This is done to handle the case where a train slows dramatically or stops after having previously sent an "activate after expiration" message as discussed above.

Once the timer is set (or reset in the event that the same train had previously sent an activate after expiration message) at step 406, or cleared at step 407, the status of the wayside equipment 102 is checked at step 408 and an ACK message including the status is transmitted at step 410. Step 402 is then repeated when the next message is received. It should be understood that the expiration of one of the timers discussed above will result in the activation of the warning system 150 by the wayside interface unit 152. For example, the wayside interface unit may be configured such that the expiration of a timer generates an interrupt, and an interrupt service routine in the wayside interface unit 152 then triggers an output that activates the wayside warning system 150. Alternatively, this functionality may be implemented as a polled function rather than an interrupt-drive function. In yet other embodiments, the timers may be implemented in hardware forming part of the warning system 150, and wayside interface unit 152 may write values to the hardware timers and activate, reset and deactivate the timers as discussed above. In this way, if the wayside interface unit 152 fails after initiating a timer, the timer will continue counting down and activate the warning system 150. Still other arrangement may be used in other embodiments.

Figure 3:
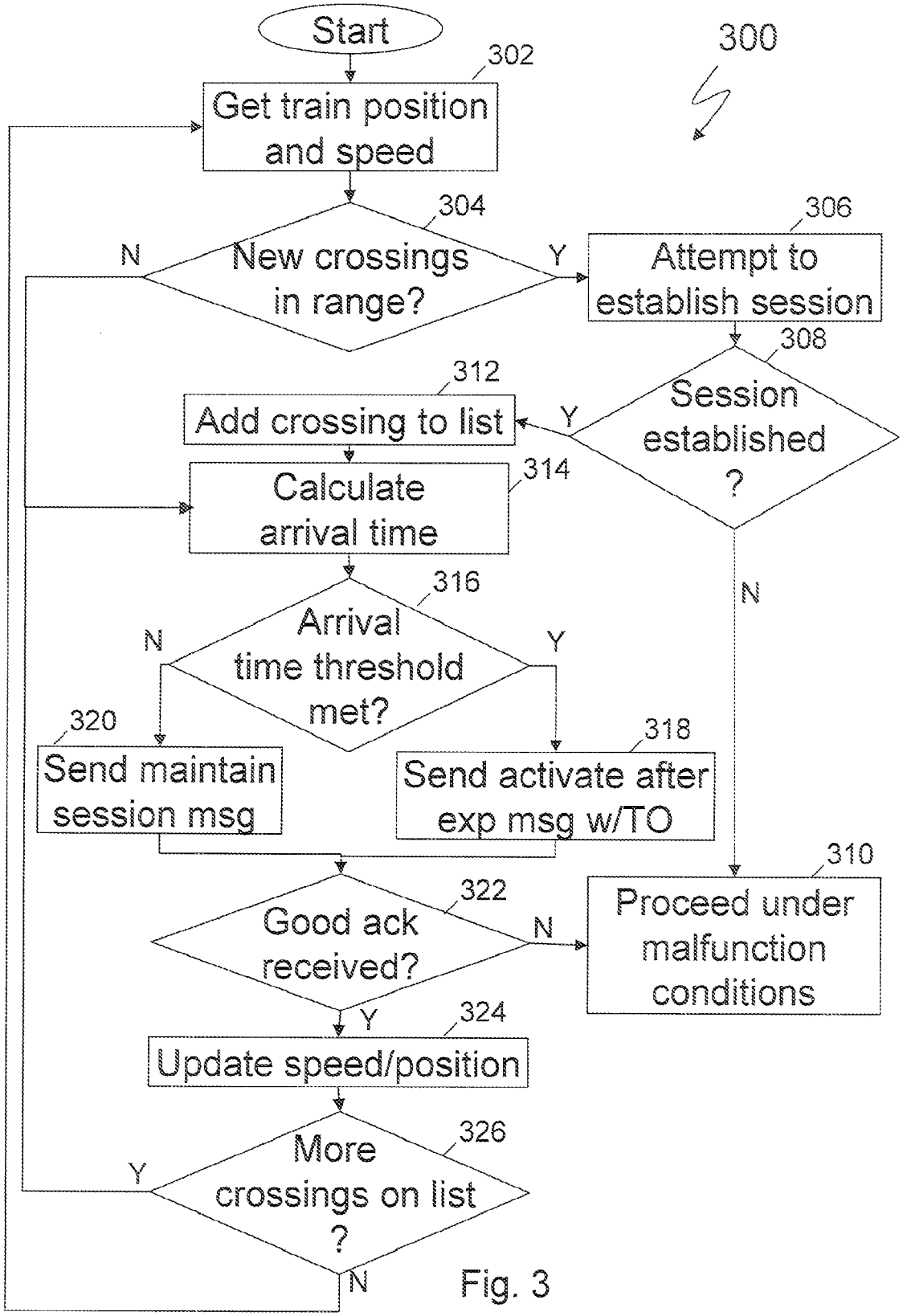
FIG. 3 is a flow chart illustrating actions performed by a processor forming part of the system illustrated in FIG. 1.

The discussion of FIGS. 3 and 4 discuss activation of the crossing warning system 150. Of course, the warning system 150 must deactivate at some point. In some embodiments, this will be triggered by an island circuit. An "island" is a term of art used in the railroad industry to refer to an area of track that more or less intersects a roadway and, sometimes, pedestrian walkways alongside the road (it is referred to as an island because in many instances this section of roadway is raised relative to other sections and thus appears as an island when the lower lying areas of road become submerged during a rainstorm). An "island circuit" is a track occupancy circuit that is configured to detect the presence of a train in the island. In some embodiments, the wayside interface unit may, once it has commanded the warning system 150 to activate, monitor the island circuit to determine when a train both enters and clears the island and, upon the train clearing the island, deactivate the warning system 150 (assuming no other timer has or is about to expire). In other embodiments, rather than relying on an island circuit, the processor 110 onboard a train can be configured to transmit a message when the end of the train has cleared the island. The ability to determine when an end of the train has cleared an island can be accomplished in any number of ways, including through use of the techniques disclosed in, e.g., U.S. Pat. Nos. 6,915,191 and/or 6,081,769.

In the embodiments discussed above, the "activate after expiration" message includes an express time period (referred to as the timeout) after which the crossing should activate. Including the time expressly in the message provides for the ability to change the time to account for train accelerations and declerations as discussed above. However, in other embodiments, the time period can be implied. For example, in a railway system in which the constant warning time is the same for all crossings (say, 30 seconds), the activate after expiration message may not expressly include any time period, and the wayside equipment may treat the message as including an implied timeout period (in other words, the message type itself indicates the timeout period). In such a system, the "activate after expiration" message need only be sent and acknowledged once. In this embodiment, the train may not have a mechanism to accelerate the activation of the warning system to accommodate any train acceleration so the constant warning and timeout periods must be chosen with this in mind, and likewise the train may not have a mechanism to delay a previously-started timer at the wayside unit to account for decelerations of the train. In yet other embodiments, such a provision could be realized by providing for a reset message to be sent from the train when a change in the timeout value is desirable due to a train acceleration or deceleration.

The above discussion illustrates how equipment onboard a locomotive can control the activation of wayside grade crossing equipment. This function is typically performed by wayside constant warning time predictor equipment as discussed above. This equipment is costly, both in terms of initial installation cost and maintenance. Thus, in some situations, the equipment discussed in FIGS. 1-4 can be used in place of this wayside constant warning time predictor equipment, leaving only the need for the wayside equipment 102 shown in FIG. 1 or 2 and, optionally, an island circuit (the need for an island circuit can be eliminated by having the train signal when it is past the island as discussed above). In such systems, it is important for the train to employ a vital positioning system. Techniques for achieving the required vitality are disclosed in U.S. Patent Pub. No. 2009/0043435, the entire contents of which are hereby incorporated herein by reference. It is also important for the communications links between the onboard equipment 101 and the wayside equipment 102 to be vital in such situations. Alternatively, the equipment described herein may be used as a backup system when conventional wayside constant warning time predictor equipment fails, or may be used together with the wayside constant warning time predictor equipment to provide redundant operation.

In the discussion of FIG. 3 above, a list of active crossings was discussed. This list allows a single process running on processor 102 to control wayside equipment 102 at multiple crossings. Those of skill in the art will recognize that it is also possible to run a separate process for each crossing. Regardless of the particular implementation, the ability to control multiple crossings provides the important benefit of being able to avoid the use of what is know in the art as DAXing. DAX is an acronym that signifies downstream adjacent crossing, and DAXing is generally used to refer to the process of using a constant warning time predictor circuit at one location to trigger the activation of crossing warning system at crossings downstream of the crossing with the wayside constant warning time predictor equipment. This can become necessary when many crossings are in close proximity (e.g., in certain urban areas). Additional information concerning DAXing can be found in co-pending U.S. application Ser. No. 12/911,092, entitled "Method and Apparatus for Bi-Directional Downstream Adjacent Crossing Signaling," the contents of which are hereby incorporated by reference herein. Using the techniques discussed herein, it becomes possible to eliminate the need for DAXing by having a train control each crossing (i.e., the multiple crossings on the list discussed above).

An exemplary sequence in a hypothetical situation in which a train approaches three closely spaced crossings is illustrated in Table 1 below:

TABLE 1

| Train | Crossing A | Crossing B | Crossing C |
|---|---|---|---|
| | 3000 ft from train at start | 4000 ft from train at start | 4300 ft from train at start |
| Train comes within range of Crossing A | | | |
| Train sends session request message to Crossing A | Crossing A sends ACK for session request message | | |
| Train sends maintain session messages with crossing A | Crossing A ACKs maintain session messages from train | | |
| Train comes within range of Crossing B | | | |
| Train sends session request message to Crossing B | | Crossing B sends ACK for session request message | |
| Train sends maintain session messages with crossing B | | Crossing B ACKs maintain session messages from train | |
| Train comes within range of Crossing C | | | Crossing C sends ACK for session request message |
| Train sends session request message to Crossing C | | | Crossing C ACKs maintain session messages from train |
| Train reaches activation threshold for crossing A and sends activate after expiration message w/10 s TO to Crossing A | Crossing A sets timer to 10 s and sends ACK | | |
| Train sends activate after expiration message w/9 s TO to Crossing A | Crossing A sets timer to 9 s and sends ACK | | |
| Train sends activate after expiration message w/8 s TO | Crossing A sets timer to 8 s and sends ACK | | |
| Train reaches activation threshold for crossing B and sends activate after expiration message w/10 s TO to Crossing B | | Crossing B sets timer to 10 s and sends ACK | |
| Train sends activate after expiration message w/7 s TO to crossing A | Crossing A sets timer to 7 s and sends ACK | | |
| Train sends activate after expiration message w/9 s TO to crossing B | | Crossing B sets timer to 9 s and sends ACK | |
| Train sends activate after expiration message w/6 s TO to crossing A | Crossing A sets timer to 6 s and sends ACK | | |
| Train sends activate after expiration message w/9 s TO to crossing B | | Crossing B sets timer to 8 s and sends ACK | |
| Train reaches activation threshold for crossing C and sends activate after expiration message w/10 s TO to Crossing C | | | Crossing C sets timer to 10 s and sends ACK |
| Train sends activate after expiration message w/5 s TO to crossing A | Crossing A sets timer to 5 s and sends ACK | | |
| Train sends activate after expiration message w/7 s TO to crossing B | | Crossing B sets timer to 7 s and sends ACK | |
| Train sends activate after expiration | | | Crossing C sets timer to 9 s and sends ACK |

TABLE 1-continued

| Train | Crossing A | Crossing B | Crossing C |
|---|---|---|---|
| message w/9 s TO to crossing C | | | |
| . . . | . . . | . . . | . . . |
| | Crossing A timer expires and crossing A warning system activates | | |
| Train sends activate after expiration message w/2 s TO to crossing B | | Crossing B sets timer to 2 s and sends ACK | |
| Train sends activate after expiration message w/4 s TO to crossing C | | | Crossing C sets timer to 4 s and sends ACK |
| . . . | . . . | . . . | . . . |
| | | Crossing B timer expires and crossing B warning system activates | |
| Train sends activate after expiration message w/2 s TO to crossing C | | | Crossing C sets timer to 2 s and sends ACK |
| . . . | . . . | . . . | . . . |
| | | | Crossing C timer expires and crossing C warning system activates |

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The purpose of the Abstract is to enable the patent office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present inventions in any way.

What is claimed is:

1. A computerized method for controlling a grade crossing warning system from a train, the method comprising:

determining by a processor located on a train a location and a speed of the train;

obtaining by the processor a location of a first crossing being approached by the train from a track database in communication with the computer;

making a determination by the processor that an estimated period of time for arrival of the train at the first crossing is below a threshold, the threshold being based at least in part on a constant warning time period, the constant warning time period being a period of time prior to arrival of the train at the first crossing at which the grade crossing warning system should activate;

in response to the determination, transmitting a message by the processor to a first wayside device, the message indicating a buffer time period at which the train will be within the constant warning time period of reaching the first crossing, whereby the first wayside device may activate the grade crossing warning system upon expiration of the buffer time period; and verifying by the processor that an acknowledgement of the message is received from the first wayside device.

2. The method of claim 1, wherein the message from the processor to the first wayside device includes a unique address for the first wayside device and the train.

3. The method of claim 1, wherein the processor is further configured to stop the train if an acknowledgement of the message is not received.

4. The method of claim 1, wherein the buffer time period is expressly included in the message.

5. The method of claim 1, wherein the processor is further configured to retrieve the constant warning time for the first crossing from the track database.

6. The method of claim 1, wherein the processor is further configured to send multiple messages indicating buffer times to the first wayside device as the train approaches the first wayside device, the buffer times in each message changing depending on a speed and position of the train.

7. The method of claim 1, wherein the processor is configured to transmit a second message to a second wayside device including a second buffer time period before the train reaches a first crossing associated with the first wayside device.

8. The method of claim 1, wherein the processor is further configured to detect when an end of the train has passed the first crossing and send a message to the first wayside device indicating that the end of the train has passed the first crossing.

9. The method of claim 1, wherein the message is transmitted directly from the train to the first wayside device.

10. The method of claim 1, wherein the message from the train to the first wayside device is routed through a central station located off of the train and spaced apart from the wayside device.

11. A method for operating a wayside device at a crossing, the method comprising:

receiving at a wayside device a first message from a first train, the first message indicating a buffer time period at which the first train will be within the constant warning time period of reaching the crossing;

setting a first timer at the wayside device based on the buffer time period of the first message;

transmitting from the wayside device an acknowledgement of the first message to the first train; and activating by the wayside device a grade crossing warning system installed at the crossing upon expiration of the timer.

12. The method of claim 11, further comprising the steps of:

receiving at the wayside device a message from a second train, the message indicating a buffer time period at which the second train will be within the constant warning time period of reaching the crossing;

setting a second timer at the wayside device based on the buffer time period of the second message;

transmitting from the wayside device an acknowledgement of the second message to the second train; and activating by the wayside device a grade crossing warning system installed at the crossing upon expiration of the earlier of first timer and the second timer.

13. The method of claim 11, further comprising:

receiving a message from the first train indicating that an end of the first train has passed the crossing; and deactivating the grade crossing warning system in response to the message indicating that an end of the first train has passed the crossing.

14. The method of claim 11, further comprising:

detecting at an island circuit that a train has entered a portion of track at the crossing associated with the island circuit;

detecting at the island circuit that the train has cleared the portion of the track at the crossing associated with the island circuit; and deactivating the warning system in response to detecting at the island circuit that the train has cleared the portion of the track at the crossing associated with the island circuit and in response to no other timer being active.

15. The method of claim 11, further comprising:

receiving at the wayside device a second message from the first train prior to expiration of the first timer, the second message indicating a second buffer time period at which the first train will be within the constant warning time period of reaching the crossing, the second buffer time period being different from a period of time in which the first timer will expire;

resetting the first timer at the wayside device based on the second buffer time period of the second message.

16. A wayside device comprising:

a transceiver;

a grade crossing warning system; and a processor connected to the transceiver and the grade crossing warning system, the processor being configured to perform the steps of receiving a first message from a first train, the first message indicating a buffer time period at which the first train will be within the constant warning time period of reaching a crossing associated with the grade crossing warning system;

setting a first timer based on the buffer time period of the first message;

transmitting an acknowledgement of the first message to the first train; and activating the grade crossing warning system installed at the crossing upon expiration of the timer.

17. The wayside device of claim 16, wherein the processor is further configured to perform the step of:

transmitting a message to the first train indicating a desired constant warning time.

18. The wayside warning device of claim 16, further comprising an island circuit connected to the processor, the processor being configured to deactivate the grade crossing warning system when the island circuit activates and deactivates after expiration of the timer.

* * * * *